US005926849A

United States Patent [19]

Boyle

[11] Patent Number: 5,926,849

[45] Date of Patent: Jul. 27, 1999

[54] BASEBALL CAP WITH A CHANNELED, LAMINATED INSIDE HEAD BAND

[76] Inventor: Kevin J. Boyle, 7887 Honeywood Hill La., Salt Lake City, Utah 84121

[21] Appl. No.: 09/052,615

[22] Filed: Mar. 31, 1998

[51] Int. Cl.[6] ..... A42C 5/02

[52] U.S. Cl. ..... 2/181.8; 2/181.2; 2/DIG. 11

[58] Field of Search ..... 2/181, 181.2, 181.8, 2/182.5, DIG. 11, DIG. 1

[56] References Cited

U.S. PATENT DOCUMENTS 5,509,144 4/1996 Soergel et al. .

5,647,064 7/1997 Whittaker .

*Primary Examiner*—Diana L. Oleksa

[57] ABSTRACT

A baseball cap having an inside head band made of a layer of material such as polyester lycra heat laminated in a mold to a layer of spongy material such as polyurethane foam and formed, as a part of the molding process, with a pattern of open channels that form passageways between the band and the head of a wearer. The open channels differ in shape, width and orientation and have rounded bottoms and rounded ridges between laterally adjacent channels.

17 Claims, 1 Drawing Sheet

BASEBALL CAP WITH A CHANNELED, LAMINATED INSIDE HEAD BAND

FIELD

The article and method disclosed in this specification pertain to apparel and particularly to a baseball cap or the like.

BACKGROUND

Articles of apparel such as baseball caps and the like have long been known and used. Typically, they comprise a crown made of a soft and pliable material such as fabric, often sewn together from several pieces of fabric, a visor made of stiffer material and extending forwardly from the lower front of the cap, an opening at the back of the crown, and size-adjusting straps bridging the gap and being adjustable in length to fit the wearer. The known baseball cap may have a sweat band along the lower inside of the crown, either only along the front portion of the crown, to help absorb sweat from the wearer's forehead, or along the entire lower inner periphery of the crown, except of course for the opening at the back of the crown.

Various improvements have been proposed for baseball caps. Examples are discussed in U.S. Pat. Nos 5,509,144 and 5,647,064 which are hereby incorporated by reference. Despite the long presence of baseball caps in the marketplace, it is believed that a need still remains for an article of apparel that is generally shaped as a baseball cap or the like but is more comfortable to wear than the known constructions, easier to manufacture and maintain, and has a more attractive appearance.

SUMMARY

A baseball cap described in this patent specification comprises a crown made of a pliable material and having a front and a back, with an opening at a lower portion of the back, a visor made of a relatively stiff material and secured to the front of the crown to extend forwardly from a lower portion of the crown, and a size-adjusting strap secured to the back of the crown to span the opening therein and having an adjustable fastener configured for adjusting the length of the strap and thereby the circumferential size of the cap. The exemplary baseball cap described herein has an inside head band secured to an inside lower portion of the crown and extending along the inside of at least the front of the crown. This inside head band comprises a layer of a material such as spandex or similar material, e.g. polyester LYCRA spandex heat-laminated in a mold to a layer of a material such as polyurethane foam, with the spandex or similar material facing the interior of the crown. The inside head band has a pattern of upwardly extending open channels which face the interior of the crown. These open channels vary in shape, size and orientation as between each other and have rounded bottoms and rounded ridges between adjacent channels.

DETAILED DESCRIPTION

Figure 1:
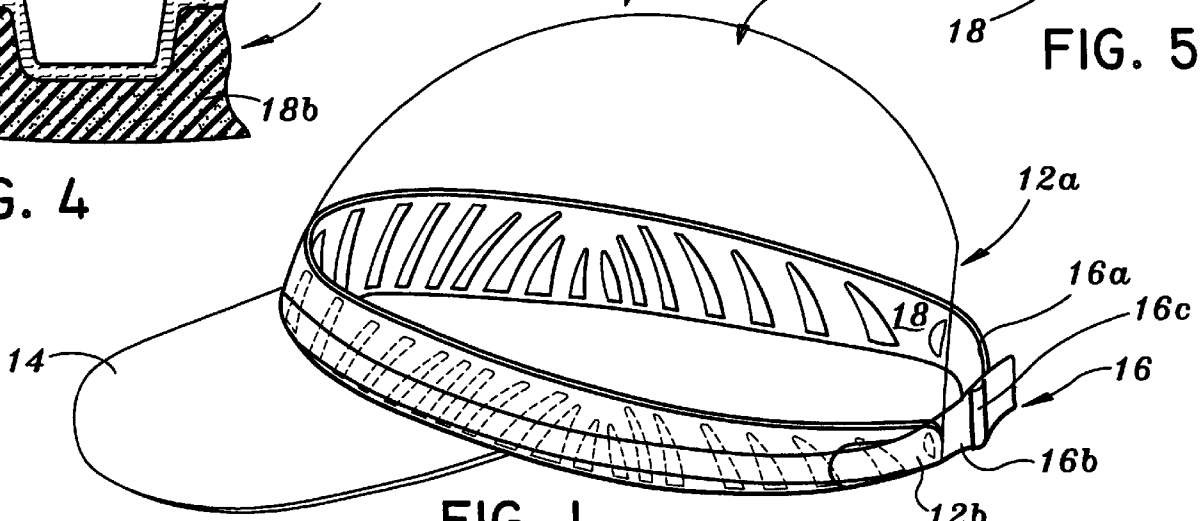
FIG. 1 is a perspective, partly cut-away view of a baseball cap illustrating an inside head band with upwardly extending open channels.

As best seen in FIG. 1, a baseball cap 10 comprises a crown 12 that typically is made of a number of pieces of a pliable fabric that are sewn or otherwise secured to each other. A visor 14 typically is made of a relatively stiff, non-woven material and is secured to the front of crown 12 to extend forwardly from a lower portion of the crown when cap 10 is in place on the head of a wearer. Crown 12 has an opening 12*a* at the lower portion of its back, and a size-adjusting strap 16 is secured to the back of the crown to span opening 12*a* therein. Strap 16 comprises two strap portions 16*a* and 16*b* each sewn or otherwise secured to a respective one of the lower ends of crown 12 at opening 12*a*, and each having a free end secured to a buckle or other fastener 16*c* such that the overall length of strap 16, and thus the head size of cap 10, can be adjusted. An inside head band 18 is secured, such as by sewing, to the inside lower portion of crown 12 and extends along the inside of the entire circumference of the lower portion of crown 12, except for opening 12*a*. A decorative strip 12*b* is secured, such as by sewing, to the outside lower periphery of crown 12, and can be made of the same material, with the same color, decorative pattern (s) if any, and appearance as size-adjusting strap 16 to create the visual impression of a continuous band extending around the entire outside lower periphery of crown 12.

Figure 2:
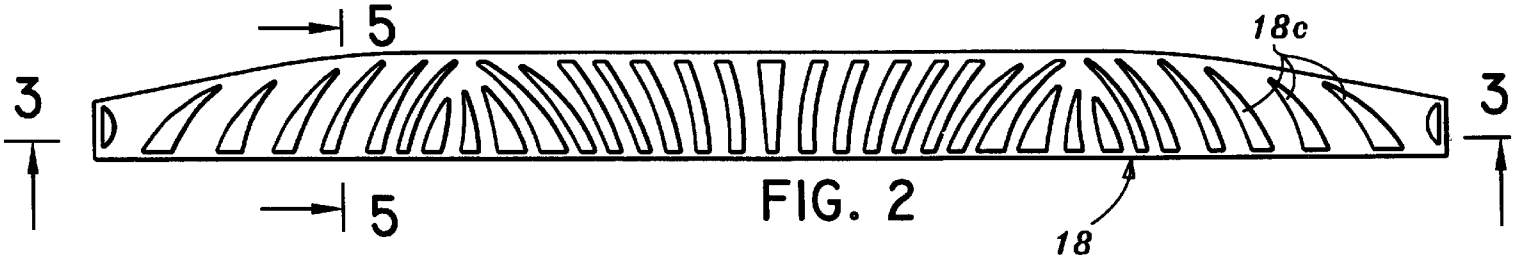
FIG. 2 is an unrolled elevation of the inside head band.
Figure 3:
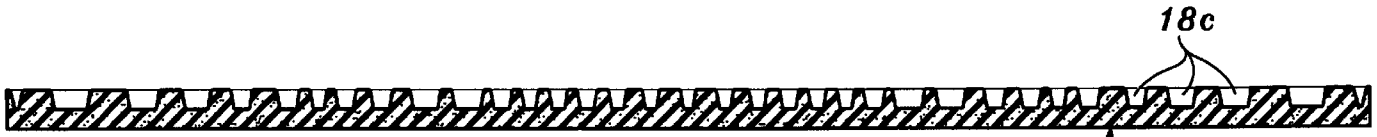
FIG. 3 is a section at line 3—3 of FIG. 2.
Figure 5:
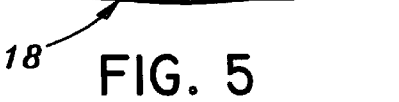
FIG. 5 is a section at line 5—5 in FIG. 2.
Figure 4:
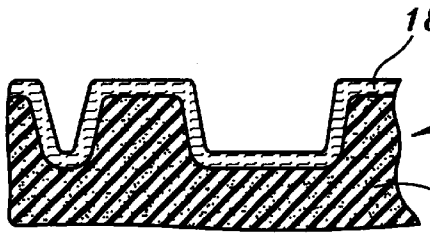
FIG. 4 is a detail of the left end of FIG. 3

As best seen in FIGS. 2–5, inside head band 18 is made of a layer of material 18*a* such as spandex or similar material heat-laminated in a mold to a layer 18*b* of a spongy material 18*b* such as polyurethane foam. When cap 10 is assembled, lycra material 18*a* faces the interior space of crown 12 to provide strength and other desirable properties while foam 18*b* remains out of direct contact with the wearer but provides other desirable properties such as softness and enhanced comfort. Inside head band 18 has a pattern of upwardly extending open channels 18*c* which face the interior of crown 12, and is thinner at its horizontal bottom and top edges 18*d*, to allow fluid flow through channels 18*c* between head band 18 and the wearer's head when cap 10 is in place on the head of a wearer and to make cap 10 more comfortable to use. The pattern of open channels comprises channels 18*c* which vary in shape, size and orientation as between each other and, as best seen in FIG. 4, have rounded cross-sections and rounded ridges between adjacent channels for improved comfort. As best seen in FIG. 2, each of most, if not all, of open channels 18*c* varies in width along the length of the channel and, while channels 18*c* extend generally upwardly, they have varying inclinations from the vertical, except for the central channel 18*c*. In addition, inside head band 18 tapers in height toward its longitudinal ends, so that channels 18*c* which are closer to the left and right ends of band 18 are shorter in height than those toward the center. Exemplary dimensions for inside head band 18 and its open channels 18*c* are shown in FIGS. 2 and 3. As best seen in FIG. 3, exemplary dimension are ½ inch for the thickness of inside head band 18 and approximately ¼ inch for the depth of open channels 18*c*. It should be understood that because of the nature of the materials of band 18, these thickness and depth dimensions can change after the mold for band 18 is opened and in the course of assembling and using cap 10.

Cap 10 can be made by the following exemplary method in which the steps set out below need not follow the same order. Crown 10 is formed by sewing together a number of pieces of fabric, leaving opening 12*a* at the back. Head-size adjusting strap 16 is sewn to the lower periphery of crown 12 to bridge opening 12*a* at the back. Decorative band 12*a* is sewn to the lower outside periphery of crown 12*a* to extend around the entire cap 10, except for opening 12*a* at the back. Strap 16 and decorative band 12*a* can be made of the same material to provide the visual appearance of a continuous decorative piece extending all the way around the lower periphery of cap 10. Visor 14 is sewn to the lower front of crown 12 to extend forwardly of crown 12 when cap 10 in is place of the head of a wearer. Inside head band 18 is formed by heat-laminating in a mold, material 18*a* such as polyester lycra over a layer of spongy material 18*b* such as polyurethane foam, to form in one operation the laminate of materials 18*a* and 18*b* and open channels 18*c*. Because of the nature of materials 18*a* and 18*b*, although the mold has sharp corners and band 18 also has sharp corners when inside the mold, as illustrated in FIGS. 2 and 3, once band 18 is out of the mold and has settled, the sharp corners change to rounded shapes as illustrated in FIG. 4. Inside head band 18 is sewn to the lower inside periphery of crown 12, with spandex or similar material 18*a* facing toward the interior space of crown 12 and with channels 18*c* extending generally vertically when cap 10 is in place on the head of a wearer.

Although the baseball cap and the method of making it have been described in terms of preferred structures and processes, it should be understood that various alterations and modifications can be made without departing from the invention and that such alterations and modifications are intended to be considered to be within the scope and spirit of the invention which is defined by the appended claims.

What is claimed is:

1. A baseball cap comprising a crown made of a pliable material and having a front and a back, with an opening at a lower portion of the back, a visor made of a relatively stiff material and secured to the front of the crown to extend forwardly from a lower portion of the crown, and a size-adjusting strap secured to the back of the crown to span the opening therein and having an adjustable fastener configured for adjusting the length of the strap and thereby the circumferential size of the cap, said baseball cap further having:

an inside head band secured to an inside lower portion of the crown and extending along the inside of at least the front of the crown;

said inside head band comprising spandex or similar material heat-laminated to a layer of polyurethane foam, with the spandex or similar material facing the interior of the crown, said inside head band having a pattern of upwardly extending open channels which face the interior of the crown to allow fluid flow through said open channels between the inside head band and a wearer's head when the cap is in place on the head of a wearer;

wherein said pattern of open channels comprises channels which vary in shape, size and orientation as between each other and have rounded bottoms and rounded ridges between adjacent channels.

2. A baseball cap as in claim 1 in which each of at least some of the channels varies in width along the length of the channel.

3. A baseball cap as in claim 2 in which the inside head band extends continuously along substantially the entire lower inside portion of the crown except for the opening at the back of the crown.

4. A baseball cap as in claim 3 in which said channels are approximately ¼ inch deep.

5. A baseball cap as in claim 1 in which the depth of said open channels is approximately half the thickness of the inside head band.

6. A baseball cap comprising:

a crown made of portions of a pliable fabric sewn together and having a front and a back, with an opening at a lower portion of the back;

a visor made of a relatively stiff, non-woven material and secured to the front of the crown to extend forwardly from a lower portion of the crown when the cap is in place on the head of a wearer;

a size-adjusting strap secured to the back of the crown to span the opening therein and having an adjustable fastener configured to adjust the length of the strap and thereby the head size of the cap; and an inside head band secured to an inside lower portion of the crown and extending along the inside of at least the front of the crown;

said inside head band comprising spandex or similar material heat-laminated to a layer of molded polyurethane foam, with the spandex or similar material facing the interior of the crown, said inside head band having a pattern of upwardly extending open channels which face the interior of the crown to allow fluid flow through said channels between the inside head band and a wearer's head when the cap is in place on the head of a wearer;

wherein said pattern of open channels comprises channels which vary in shape, size and orientation as between each other and have rounded cross-sections and rounded ridges between adjacent channels.

7. A baseball cap as in claim 6 in which each of at least some of the channels varies in width along the length of the channel.

8. A baseball cap as in claim 7 in which the inside head band extends continuously along substantially the entire lower inside portion of the crown except for the opening at the back of the crown.

9. A baseball cap as in claim 8 in which said channels are approximately ¼ inch deep.

10. A baseball cap as in claim 9 in which the inside head band extends continuously along the entire lower inside portion of the crown except for the opening at the back of the crown.

11. A baseball cap as in claim 6 in which the inside head band extends continuously along substantially the entire lower inside portion of the crown except for the opening at the back of the crown.

12. A baseball cap as in claim 6 in which said channels are approximately ¼ inch deep.

13. A baseball cap as in claim 6 further comprising a decorative strip secured to the outside of the lower periphery of the crown and visible when the cap is in place on the head of a wearer.

14. A baseball cap as in claim 13 in which the decorative strip and the size-adjusting strap are made of the same material and have the same color, decorations and appearance to create the visual impression of a continuous band extending around the entire outside lower periphery of the crown.

15. A method of making a baseball cap comprising the steps of:

forming a crown by sewing together a number of pieces of fabric, leaving an opening at the back of the crown;

sewing a head-size adjusting strap to the lower periphery of the crown to bridge the opening at the back of the crown, said strap having a size adjusting buckle;

sewing a decorative band to the lower outside periphery of the crown to extend around the entire cap, except for the opening at the back of the cap, said strap and decorative band being made of the same material to provide the visual appearance of a continuous decorative piece extending all the way around the lower periphery of the cap;

sewing a visor to the lower front of the crown to extend forwardly of the crown when the cap in is place of the head of a wearer;

forming an inside head band by heat-laminating in a mold, spandex or similar material over a layer of molded polyurethane foam to form, through said molding, a head band having a plurality of open channels which extend generally transversely of the length of the head band and vary in size and shape as between different channels; and sewing the inside head band to the lower inside periphery of the crown, with the spandex or similar material facing the interior of the crown, with the channels extending generally upwardly when the cap is in place of the head of a wearer.

16. A method as in claim 15 in which the step of forming the inside band comprises forming at least some of the channels to vary in width along the length thereof.

17. A method as in claim 15 in which the step of forming the inside head band comprises forming said channels to have depths of approximately ¼ inch and to have rounded bottoms in coronal section when the cap is in place on the head of the wearer.

* * * * *